United States Patent [19]

Barth et al.

[11] 4,423,805

[45] Jan. 3, 1984

[54] RATCHET ESCAPEMENT COIN COUNTER

[75] Inventors: Douglas A. Barth, Sinclairville; Richard J. Chester, Kennedy, both of N.Y.

[73] Assignee: American Locker Security Systems, Inc., Jamestown, N.Y.

[21] Appl. No.: 288,008

[22] Filed: Jul. 29, 1981

[51] Int. Cl.[3] ..... G07F 5/04; G07F 17/12

[52] U.S. Cl. ..... 194/1 G; 194/1 L; 194/32; 194/51

[58] Field of Search ..... 194/1 G, 1 L, 32, 51, 194/59, 92, DIG. 2, DIG. 3

[56] References Cited

U.S. PATENT DOCUMENTS

| | | | |
|---|---|---|---|
| 2,957,568 | 10/1960 | Gabrielsen | 194/18 |
| 2,996,163 | 8/1961 | Baker, Jr. | 194/37 |
| 3,050,169 | 8/1962 | Stackhouse | 194/19 |
| 3,193,074 | 7/1965 | Stackhouse | 194/92 |
| 3,228,506 | 1/1966 | Stackhouse | 194/92 |
| 3,599,770 | 8/1971 | Stackhouse | 194/92 |
| 3,773,158 | 11/1973 | Wada | 194/32 |
| 3,841,458 | 10/1974 | Kinoshita | 194/32 |
| 3,917,046 | 11/1975 | Yorisue et al. | 194/9 |
| 4,072,223 | 2/1978 | Kinoshita et al. | 194/54 |
| 4,131,191 | 12/1978 | Barth | 194/92 |

*Primary Examiner*—F. J. Bartuska

*Attorney, Agent, or Firm*—Bean, Kauffman & Bean

[57] ABSTRACT

A lock unit incorporates an improved coin counter or mechanism adapted to selectively accommodate the lock unit for operation by one or more coins of a given denomination.

16 Claims, 7 Drawing Figures

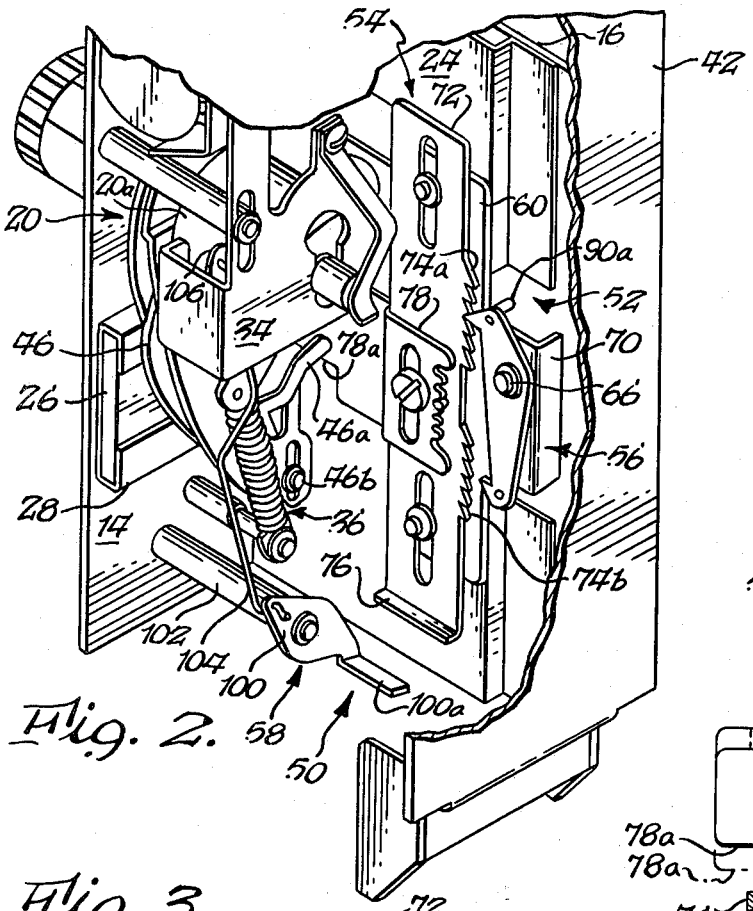
Fig. 2.
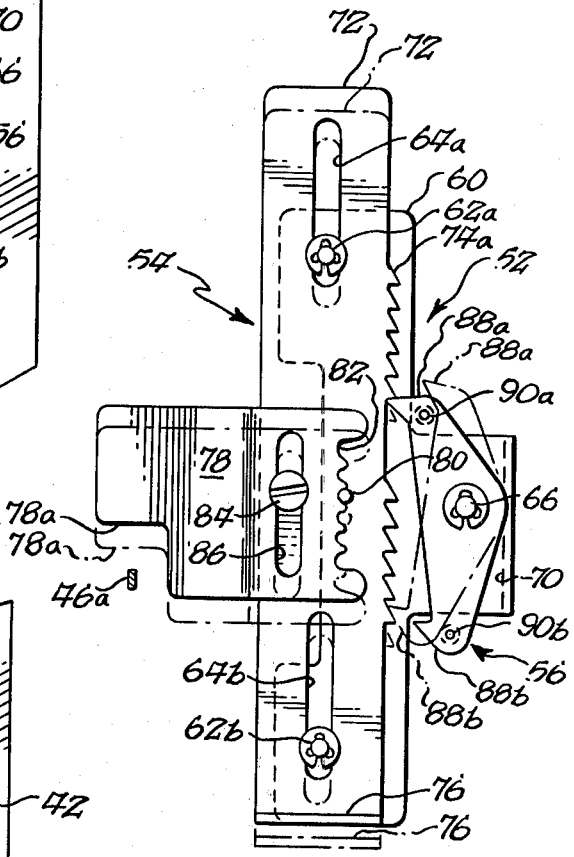
Fig. 5.
Fig. 3.
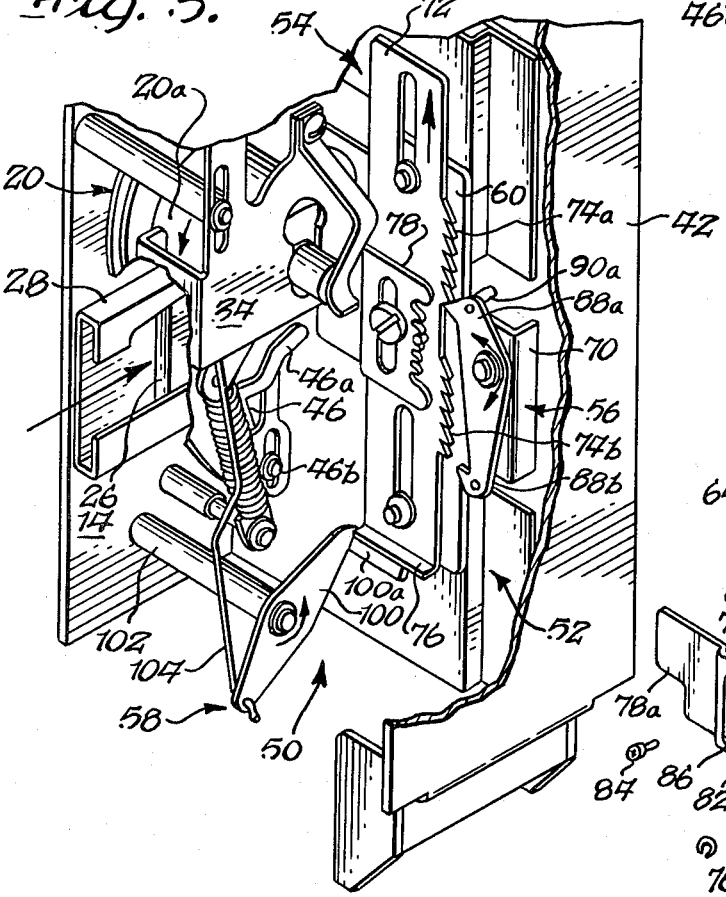
Fig. 6.
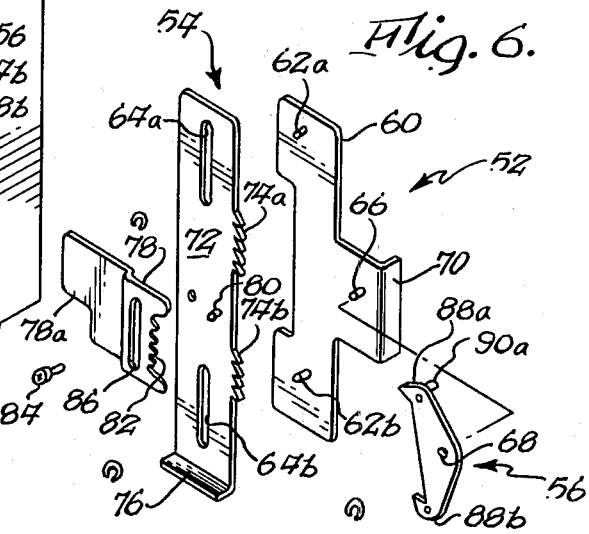

RATCHET ESCAPEMENT COIN COUNTER

BACKGROUND OF THE INVENTION

Typical prior commercial rental lockers or storage cabinets are fitted with lock units adapted to be operated upon the sensing of one or two coins dropped into the lock unit and temporarily retained within its coin chute for sensing purposes. Heretofore, when desired to increase the number of coins required to permit patron use of such rental lockers, it has normally been necessary to replace their original lock units with new lock units of increased capacity. However, presently available replacement lock units have certain limitations, including the relatively limited number of coins, which can be conveniently retained within a given lock unit coin chute for sensing purposes and/or their relatively large size, which requires reworking of the original locker cabinet.

The foregoing problems have been recognized and overcome to some extent in connection with new locker cabinet installations by providing lock units with coin accummulators, which do not require the deposited coins to be retained within a coin chute for sensing purposes. Specifically, it has been proposed for instance in U.S. Pat. Nos. 3,841,458; 3,917,046 and 4,072,223 to provide a lock unit with a slide member having ratchet teeth engaged by a coin sensing pawl; the pawl permitting stepwise movements of the slide member each time a deposited coin passes downwardly through an associated coin chute. Thus, in these prior constructions, the coin chute is not employed to temporarily retain coins for sensing purposes, and accordingly, its length is not a limiting factor on the number of coins employed for purposes of operating the lock unit. Rather, the limiting factors controlling the number of coins which may be used for operating purposes, include the number of teeth provided on the slide member and the spacing between adjacent teeth. Reference may be also made to U.S. Pat. Nos. 2,957,568; 2,996,163 and 3,050,169 for somewhat similar coin accumulator mechanisms.

However, accummulator mechanisms of the general type mentioned above possess certain drawbacks, including their cost and/or complexity of manufacture and maintainance, and their inability to serve as a simple replacement for the coin intercepting/engaging mechanisms of previously installed single or double coin operated lock units, so as to permit the refurbishing or reconstruction of such lock units for subsequent use. Moreover, accummulator mechanisms of which we are aware and which might be otherwise suitable for use with a lock unit, have the additional drawback that they sense the passage of all coins passing through the coin chute with which they are associated, without regard to their denomination, and therefore require the provision of separate means to prevent the passage into the coin chute of coins having a demonination other than that intended for lock operating purposes.

SUMMARY OF THE INVENTION

The present invention is directed towards an improved coin counter or accummulator mechanism and more particularly to a coin counter mechanism particularly adapted for use in coin operated lock units having multiple coin operating requirements.

The present coin counter mechanism is generally characterized as including a coin detecting means including operator means supported for stepwise movement relative to a sensing station in response to the depositing of successive coins of a given denomination in a coin chute; and sensing means arranged at the sensing station and operable to release the lock unit for required operation upon movement of the operator means into operative association with the sensing means at the sensing station. Preferably, the operator means is made adjustable in order to selectively vary the number of stepwise movements required for movement thereof into operative association with the sensing means, whereby to selectively vary the number of coins required to be deposited for purposes of operating the lock unit.

A particularly important feature of the present invention is that the coin detecting means includes an improved escapement having a pivotally supported pawl provided with pairs of ratchet teeth engaging pawl elements and coin engaging pins adjacent its opposite ends, wherein successive engagements of the pawl elements with the ratchet teeth incident to a single cycle of pawl operation, which comprises oppositely directed pivotal movements thereof, is required to complete each stepwise movement of the operator means. The pins are arranged relative to each other and stationary guides comprising a coin chute, so as to insure pivotal of the pawl through a complete cycle only when the pins are engaged in a predetermined sequence by coins passing downwardly through the coin cycle and at least the last to be engaged pin is engaged by a coin of a given denomination. Thus, the improved construction provides for the counting of a preselected number of given denomination coins, regardless of the total number or denomination of coins actually deposited in a coin chute.

The present invention is adapted for use in the construction of new lock units, while also possessing particular utility in connection with the refurbishing or reconstruction of prior lock units of the type disclosed for instance in U.S. Pat. Nos. 3,193,074; 3,228,506; 3,599,770 and 4,131,191, such as to permit same to be accommodated for operation by desired numbers of coins without requiring reworking of their locker cabinets.

DRAWINGS

The nature and mode of operation of the present invention will now be more fully described in the following detailed description taken with the following drawings wherein:

FIG. 2 is a fragmentary view similar to FIG. 1, but showing displacement of an operator means resulting from the depositing of three coins of given denomination within the lock unit;

FIG. 3 is a fragmentary view similar to FIGS. 1 and 2, but showing the locked unit in its locked condition;

FIG. 5 is a side elevational view of a preferred form of the coin counter of the present invention;

FIG. 6 is an exploded perspective view of the coin counter shown in FIG. 5.

DETAILED DESCRIPTION

Figure 1:
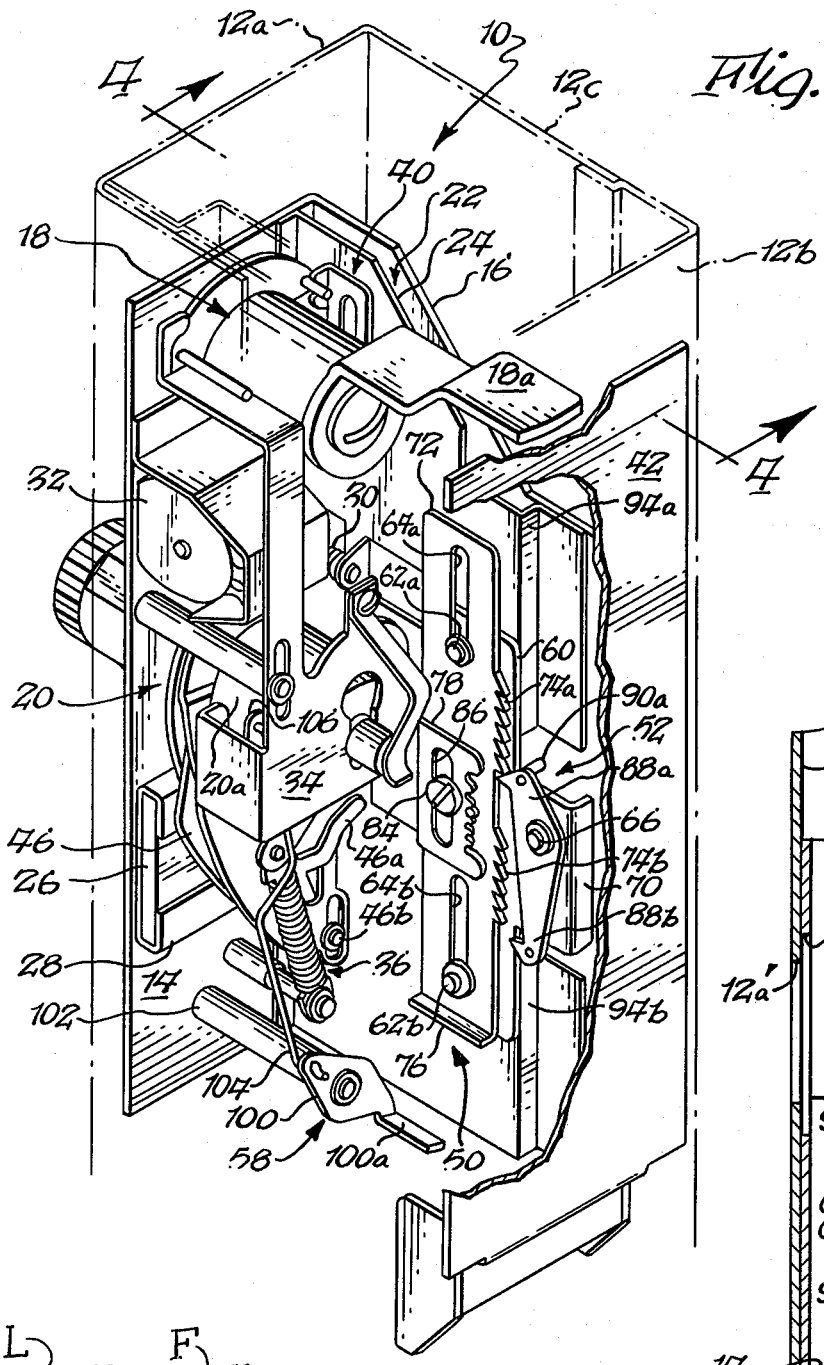
FIG. 1 is a perspective view of a lock unit incorporating the present invention, as viewed from the rear of such unit when in its unlocked condition and mounted within a mounting post forming part of a locker cabinet.
Figure 7:
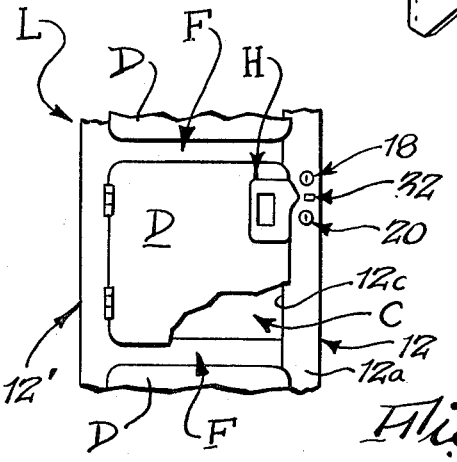
FIG. 7 is a front elevational view of a locker cabinet in which a lock unit incorporating the present invention may be employed.

Reference is now made to FIG. 1, wherein a lock unit embodying the present invention is generally designated as 10 and shown as being mounted within a lock unit mounting post or channel 12, which forms a part of a rental locker cabinet designated as "L" and shown for purposes of reference only in FIG. 7. It will be understood that in a typical locker cabinet construction, mounting post 12 or its equivalent cooperates with a hinge mounting post 12' to horizontally bound a column of storage compartments "C", wherein the compartments of each column are vertically separated by horizontal frame members "F" extending between such posts. The forwardly facing access openings of the storage compartments are selectively closed by suitable doors "D", which are provided with handles "H" and hingedly secured to post 12'. Doors "D" are adapted to be selectively/releasably maintained in locked or storage compartment closed condition by associated lock units 10 spaced vertically of post 12 in horizontal alignment one with each storage compargment.

Lock unit 10 is shown in FIGS. 1–3 as generally including a frame, such as may be defined by a front plate 14 and a side plate 16 extending rearwardly therefrom; key operated custodian and patron locks 18 and 20, respectively, which are mounted on and extend through front plate 14; a custodian lock latch plate **18*a* for use in releasably retaining lock unit 10 mounted within post 12; a coin chute 22, which may be defined by the inner surface of side plate 16 and a guide plate 24 fixed thereto and communicates at its upper end with a coin insertion slot 22' formed in front plate 14; a patron lock operated locking device, such as may be defined by a lock bolt 26 supported by a front plate mounted guide channel 28; and means for normally restraining movement of lock bolt 26 from its unlocking or retracted position shown in FIGS. 1 and 2 into its locking or extended position shown in FIG. 3, until a given number of coins of a given denomination of a given currency has been inserted within coin chute 22. Lock unit 10 may also include a patron lock release rod 30, which slidably projects forwardly through front plate 14 and normally serves to prevent operation of patron lock 20 until its associated door "D" is in closed condition; a suitable counter mechanism 32, whose numerals are viewable through an opening provided in front plate 14; a control bar 34, which is slidably supported on front plate 14 for use in releasably retaining a patron key receiving cylinder of patron lock 20 mounted within its associated housing, and for establishing whether lock unit 10 is to be operated on a pay or non-pay basis; and a spring biased over-center device 36 operable to alternatively bias lock bolt 26** into its locking or unlocking positions.

The structure of lock unit 10, as thus far generally described, is conventional and disclosed in various forms for instance in U.S. Pat. Nos. 3,193,074; 3,228,506; 3,599,770 and 4,131,191, whose disclosures are specifically incorporated by reference herein. Similar disclosure is to be found in a commonly assigned patent application Ser. No. 288,009, now U.S. Pat. No. 4,384,641, which is entitled COIN LOCK WITH CUSTODIAN ACCESS and names Mr. Wells F. Stackhouse as sole inventor, and whose disclosure is also specifically incorporated by reference herein. Moreover, such patent application contains a detailed disclosure of a preferred commercial embodiment of lock unit 10, which is generally illustrated in the present drawings, and the mode of mounting same within a mounting post 12 of unique construction. In accordance with such patent application, mounting post 12 includes a forwardly facing or front flange portion **12*a*, a rearwardly facing or rear flange portion 12*b* and an interconnecting or side flange portion 12*c*. Front flange portion 12*a* is formed with suitable apertures/slots for positionally locating and permitting operation of lock unit 10, such as for instance would include apertures for receiving projecting front ends of custodian lock 18 and patron lock 20, as generally illustrated in FIG. 7; an aperture for permitting viewing of countermechanism 32; an aperture for freely receiving the projecting front end of patron release rod 30; and a coin insertion slot, which is designated at 12*a'* and intended to be aligned with coin insertion slot 22' in the manner shown in FIG. 4. Further, rear flange portion 12*b* is formed with a lock unit insertion or mounting opening 12*b'*, which is accessible from within the confines of storage compartment "C" and depicted only in FIG. 4; and side flange portion 12*c*, which bounds one side of the access opening of said storage compartment is formed with a slot opening, not shown, for accommodating movements of lock bolt 26** between its unlocked and locking positions.

In accordance with the invention disclosed in the above mentioned patent application, custodian lock 18 and patron lock 20 are operably coupled by an actuating member 40 in a manner permitting a custodian to effect unlocking/locking movements of lock bolt 26, when required to gain access to a locked storage compartment for inspection and/or lock unit removal purposes and the key of the patron lock is withdrawn therefrom and unavailable for use. Further, in accordance with such invention, lock unit 10 is fitted with a security or closure plate 42 sized to bridge across mounting opening **12*b'*, when the lock unit is mounted within post 12, and latch plate 18*a* is arranged and sized to engage with the inner surface of rear flange portion 12*b*** for purposes of releasably retaining the lock unit in its mounted position.

Typically, in prior lock units of the type described in the above mentioned patents, coin insert slot 22' is sized or means are provided in association therewith for the purpose of limiting the maximum diameter of coins, which may be inserted into coin chute 22 for lock unit operation purposes, and the coin chute is sized/shaped to constrain inserted coins to pass on edge downwardly therethrough. Further, such prior lock units are provided with restraining means comprising a patron lock operation control pawl, which is retained as part of the present construction and generally designated as 46 in FIGS. 1–3, and a coin gauging device, not shown. In prior restraining means of this type, the coin gauging device is supported by guide plate 24 and arranged to extend into coin chute 22 for the purpose of supporting one or more inserted coins, such that when the coins are all of a given or desired diameter, which is characteristic of a given denomination, the last to be inserted one of such coins is arranged at a sensing station in which it can be engaged for sensing purposes by a feeling finger **46*a*, which is formed as part of pawl 46 and adapted to be inserted into the coin chute through a suitable aperture, not shown. In operation, pawl 46 is biased by the suitable spring, not shown, for pivotal movement about a front plate mounted pin 46b in a clockwise direction, as viewed in FIG. 1, such that its upper end is normally arranged for engagement with one or more teeth, also not shown, associated with a rotatable barrel 20a of patron lock 20 in order to prevent rotation thereof for purposes of effecting movement of lock bolt 26 into its extended or locking position. However, when a coin is supported in the sensing station, engagement of feeling finger 46a therewith will serve to limit the extent of pivotal movement of pawl 46 and thus prevent its engagement with the teeth of patron lock barrel 20a and thereby permit extension of lock bolt 26** for door locking purposes.

The present invention is directed towards a coin counter device, which is generally designated as 50 in the drawings and particularly adapted to provide a new lock unit with a selectively adjustable coin operating capability, wherein the maximum number of coins which may be required to operate the lock unit is not limited by the length of its coin chute or the number of coins, which may be properly supported therein at any given time. More specifically, coin counter device 50 is shown in FIGS. 1–3 as generally comprising a coin detecting means 52, which includes operator means 54, which is supported for stepwise movement from a first position thereof shown in FIG. 1 relatively towards a "sensing station" defined by the positioning of feeler finger 46a, and a coin sensing pawl means 56, which serves to control movement of the operator means; and return means 58, which serves to return the operator means to its first position subsequent to completion of a sensing operation.

In a presently preferred construction, coin detecting means 52 is formed as a unit, wherein operator means 54 and coin sensing pawl means 56 are supported by a common mounting plate 60, which is in turn adapted to be suitably fixed, as by spot welding, to the outwardly facing surface of guide plate 24, so as to extend vertically and parallel to coin chute 22 in the manner best shown in FIGS. 1, 2 and 3. More specifically, mounting plate 60 is best shown in FIGS. 5 and 6 as being provided with upper and lower guide pins 62a and 62b, which are sized to be slidably received within a pair of vertically aligned guide slots 64a and 64b formed in operator means 54; a pivot pin 66, which is sized to be rotatably received within a pivot or bearing opening 68 formed in pawl means 56; and a depending stop or abutment flange portion 70 whose purpose will hereinafter become apparent.

Operator means 54 is shown in the drawings as being in the form of a vertically elongated plate 72, which has its rear edge formed with upper and lower ratchet teeth 74a and 74b uniformally spaced apart in the direction of sliding movement thereof and its lower end formed with an outturned or return flange 76; and an operator member 78, which is adjustably positioned relative to plate 72 by means of a pin 80 removably fitted within one of a plurality of uniformly spaced recesses 82 and releasably secured thereto by suitable means, such as by a threaded fastener 84 received within a slot opening 86. It will be understood that the center to center distance between adjacent recesses 82 is intended to essentially correspond to the distance traveled by control means 54, during each stepwise movement thereof, and that the positioning of member 78 relative to plate 72 controls the number of stepwise movements of the control means required to arrange the forwardly projecting or free end 78a of member 78 in the "sensing station", wherein it is arranged for engagement by feeling finger 46a. A suitable bias, such as that established by gravity in the present construction, is employed to effect movement of operator means 54 relatively towards the "sensing station" under the control of pawl means 56 in the manner to be described.

Pawl means 56 is best shown in FIG. 5, as having upper and lower pawl elements 88a and 88b, which are arranged for engagement with ratchet teeth 74a and 74b, respectively; and associated upper and lower coin engaging pins 90a and 90b, which are disposed to extend essentially parallel to the axis of pivot pin 66.

Figure 4:
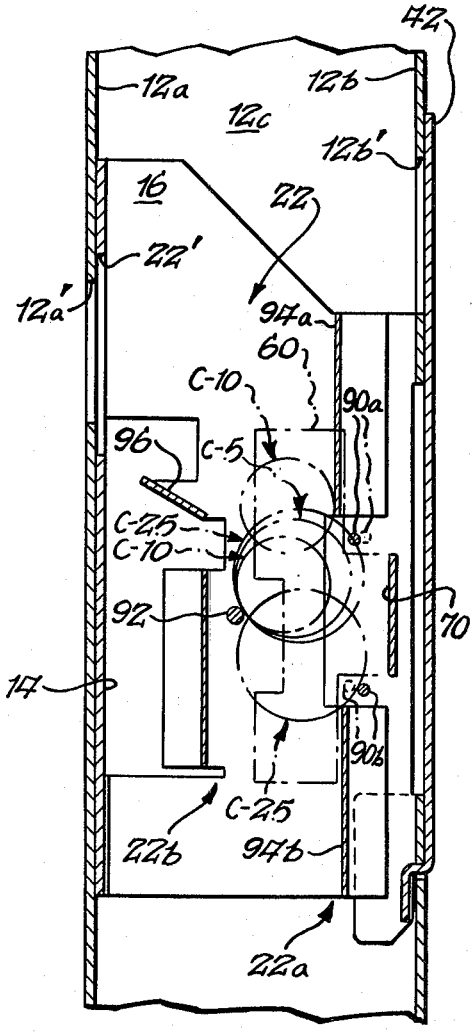
FIG. 4 is a sectional view taken generally along the line 4—4 in FIG. 1.

By reference to FIG. 4, it will be understood that upper and lower pins 90a and 90b are intended to project transversely of coin chute 22 adjacent its rear edge 22a and to cooperate with a stationary or reference means 92, which extends transversely of the coin chute adjacent its front edge 22b and vertically intermediate the upper and lower pins. Reference means 92 may be suitably defined, as by a pin fixed to guide plate 24 or, if desired, by a pin fixed to mounting plate 60 and arranged to extend through a suitable aperture formed in the guide plate.

By again making reference to FIGS. 4 and 5, it will be understood that pawl means 56 is supported for pivotal movement between a first position, shown in full line, wherein upper and lower pawl elements 88a and 88b engage with and are removed from engagement with ratchet teeth 74a and 74b, respectively, and their associated upper and lower pins 90a and 90b are disposed in coin engaging and operative positions, respectively; and a second position, shown in broken line, wherein pawl elements 90a and 90b are removed from engagement and engage with ratchet teeth 74a and 74b, respectively, and their associated upper and lower pins 90a and 90b are disposed in operative and coin engaging positions, respectively. A suitable bias, such as that established by gravity in the present constuction, is employed to bias pawl means 56 from its second position relatively towards its first position.

When pins 90a and 90b are disposed in their coin engaging positions, they are spaced from reference means 92 thrugh a distance less than the diameter of coins of a given denomination of a given currency intended for use in operating lock 10, such as for instance, U.S. twenty-five (25) cent coins shown in broken line and designated as C-25 in FIG. 4. For purposes of comparison, U.S. coins of five (5) and ten (10) cent denomination, are also shown in broken line in FIG. 4 and designated as C-5 and C-10, respectively. Preferably, the minimum spacing between pins 90a and 90b and reference means 92 would slightly exceed the diameter of the next smaller diameter coin of the given currency, e.g. C-5, so as to permit all coins of a given currency having a diameter smaller than the diameter of a given denomination coin intended for use in operating lock unit 10 to pass freely downwardly between pins 90a and 90b and reference means 92 without movement of such pins toward their respective operative positions. The operative positions of the upper and lower pins are dictated by the requirement that they be spaced from reference means 92 through a distance sufficient to permit passage of a given denomination con therebetween, as illustrated in the case of coins C-25 in FIG. 4.

Further with reference to FIG. 4, it will be understood that in the presently preferred construction the rear edge 22a of coin chute 22 is defined by upper and lower guide flanges 94a and 94b, which may be formed integrally with guide plate 24 and have their vertically adjacent ends spaced apart sufficiently to accommodate pins 90*a* and 90*b* therebetween. Also, upper guide flange 94*a* is preferably forwardly inset within coin chute 22 relative to upper pin 90*a*, such that the upper pin is masked from engagement with coins rolling down chute inlet ramp 96, which may also be formed as an integral part of guide plate 24. Thus, coins inserted within coin chute 22 are first directed by inlet ramp 96 into engagement with upper guide flange 94*a*, which serves to direct such coins downwardly past upper pin 90*a* and into engagement with reference means 92, which in turn directs such coins to travel downwardly and rearwardly beneath upper pin 90*a* for engagement with flange 70 and/or lower pin 90*b*; the latter then serving to direct such coins for travel downwardly and forwardly between the lower pin and the reference means for discharge from the coin chute. Coins having a diameter less than the given diameter of coins intended to effect operation of lock unit 10 tend to freely pass between reference means 92 and upper pin 90*a*, when in its coin engaging position, but even if such coins should randomly engage with the upper pin, the degree of force applied thereto is by design insufficient to overcome both the bias applied to pawl means 56 and frictional force resulting from engagement of upper pawl element 88*a* with ratchet teeth 74*a*, such as would effect sufficient movement of the upper pin towards its operative position to result in pivotal movement of pawl means 56 into its second position. Such coins, after passing upper pin 90*b* may engage lower pin 90*b* alone or the lower pin after first striking flange 70, but in either case, the lower pin remains stationary in its operative position or is returned thereto, if slightly displaced due to any limited movement of the upper pin occurring as a result of random coin contact of the type described above. It will be noted by viewing FIG. 4, that flange 70 is spaced from lower pin 90*b* through a distance, which is preferably less than one-half of the diameter of the smallest diameter coin of the given currency in order to prevent same from being supported by edge-to-edge engagement with the flange and lower pin, which might otherwise result in blockage of the coin chute. Thus, it will be apparent that the illustrated construction permits coins of a diameter less than the diameter of coins intended to operate lock unit 10 to pass downwardly through the coin chute without effecting lock operation, whereafter they may be directed for storage in a coin box or for return to a patron, as desired.

By again referring to FIGS. 4 and 5, it will be understood that when a given denomination coin is inserted within the coin chute, it is required to follow the same path therethrough, as previously described for coins of smaller diameter. However, the given denomination coin, e.g. C-25, is of a diameter sufficient to effect movement of upper pin 90*a* into its operative position incident to passage of such coin between the upper pin and reference means 92. This results in movement of pawl means in a clockwise direction into its second position illustrated in broken line in FIG. 5 and resultant lowering of operator means 54 under gravity bias until an appropriate one of ratchet teeth 74*b* is supported by lower pawl element 88*b*. Subsequently, coin C-25 passes between reference means 92 and lower pin 90*b* to effect movement of the lower pin from its coin engaging position into its operating position and resultant return of pawl means 56 to its first position and thus complete one operational cycle of coin detecting means 52. As will be apparent, operator means 54 again moves downwardly under its bias, during return movement of pawl means 56 to its first position, wherein upper pawl element 88*a* is again positioned for supporting engagement with an appropriate one of upper ratchet teeth 74*a*. The total extent of vertical movement of operator means 54 occurring incident to the above described operational cycle is considered as comprising one complete stepwise movement of the operator means.

From the foregoing, it will be understood that this present construction provides an improvement over prior lock units employing coin gauging devices, since it permits operation of a lock unit by adjustably selected numbers of coins not limited by the length of a coin chute. Furthermore, it represents an improvement over prior lock units employing ratchet type escapement coin counters, since it permits coin gauging and counting operations to be effected by a single compact unit.

For purposes of reference, coin detecting means 52 is shown in the drawings as being sized and arranged relative to feeling finger 46*a*, such as to permit adjustment thereof to accommodate lock unit 10 for operation by from one to six coins of a given denomination depending upon locker cabinet installation requirements. Specifically, pin 80 is shown as being placed in the third one of recesses 82, such that three C-25 coins are required to effect three stepwise movements of operator means 54 through a total distance sufficient to place member 78*a* in the "sensing station", as illustrated in FIG. 2, wherein it is arranged for engagement by feeling finger 46*a* to permit operation of patron lock 20 for cabinet door locking purposes. It will be understood, however, that any desired number of recesses 82 may be provided consistent with lock unit size limitations and/or operator means may be provided with a first position arranged relatively above that illustrated in FIGS. 1 and 3, such as to require two or more stepwise movements thereof before it can be placed in the "sensing station", even when pin 80 is placed in the first or upper one of recesses 82.

By now referring successively to FIGS. 2, 3 and 1, it will be understood that in the presently preferred construction, return means 58 serves to return operator means 54 to its first position incident to operation of patron lock 20 for lock bolt extension purposes, and to thereafter maintain the operator means in such position, until subsequent operation of the patron lock for lock bolt retraction purposes, whereupon the operator means is again freed for stepwise movements from its first position, as properly sized coins are deposited in coin chute 22. More specifically, return means 58 is shown as including a return pawl 100, which is pivotally supported by front plate mounted pivot pin 102 and operably coupled to patron lock barrel 20*a* by a drive link 104, whose opposite ends are pivotally connected to one end of the return pawl and a flange 106 fixed for rotation with the patron lock barrel. The other end of return pawl 100 is fitted with a transversely projecting flange portion 100*a*, which is arranged to be swung into underlying engagement with and effect lifting of plate flange 76 for purposes of returning operator means 54 to its first position. If desired, return means 58 may be otherwise constructed, such as for instance by having drive link 104 coupled directly to lock bolt 26 or by providing a direct loss motion drive connection between patron lock barrel 20*a* and plate 72 so as to permit mounting of the return means as part of unitized coin detecting means 52.

While coin counter device 50 has been specifically illustrated and described as comprising part of a newly developed lock unit, it will be understood that same is also particularly adapted for use in refurbishing existing lock units by permitting replacement of their coin gauging devices in order to accommodate such lock units for operation by greater numbers of coins. The exact construction of an existing lock unit will of course determine the extent of reconstruction required to adapt same to receive the present invention. Thus, for certain existing lock units it may be possible to simply replace their coin gauging devices and rework their coin chutes, such as by cutting away portions of the guide plates bounding same, as required to accommodate pins 90*a* and 90*b* and reference means 92, whereas for other existing units it would be more practical or necessary to wholly replace the guide plates of such coin chutes with guide plates of the design illustrated in the drawings. Again, the specific construction of return means 58 and the mode of mounting same will depend to a great extent upon the structure of the lock unit to be refurbished.

It will also be understood that while a preferred form of the invention has been illustrated and described as permitting selective adjustment of the coin operating characteristics of a lock unit, the invention is not limited thereto. In this respect, it is contemplated that the present invention possesses more limited utility in the manufacture or refurbishing of lock units or the like, wherein a large number coin operating capability is required, without resort to the provision of separate coin gauging and counting stations, and adjustability is not a critical factor.

What is claimed is:

1. In a coin operated lock unit of the type having a coin chute through which coins having a diameter not exceeding a given diameter of a coin of a given denomination of a given currency are permitted to pass on edge therethrough, a patron lock coupled with a locking device movable upon operation of said patron lock between unlocking and locking positions, and restraining means normally operable for preventing movement of said locking device from said unlocking position into said locking position until a predetermined number of coins of said given denomination have been deposited in said coin chute, the improvement wherein said restraining means comprises in combination:

coin detecting means including operator means biased for movement from a first position thereof in a direction relatively towards a sensing station, said operator means has ratchet teeth spaced apart in alignment with said direction of movement and adjustably mounts a member in one of a plurality of positions spaced apart in alignment with said direction of movement, and said coin detecting means additionally includes a coin sensing pawl means releasably engageable with said ratchet teeth for permitting stepwise movements of said operator means from said first position under said bias towards said sensing station in response to depositing of said coins of said given denomination in said coin chute, the spacing between said positions of said member corresponding essentially to a given distance moved by said operator means incident to each stepwise movement thereof;

sensing means arranged at said sensing station and operable to release said locking device for movement into said locking position upon movement of said member into operative association with said sensing means at said sensing station, and said member is selectively adjustable relative to said operator means to vary the number of stepwise movements required to move said operator means from said first position to position said member in operative association with said sensing means, whereby to selectively vary the number of coins of said given denomination required to be deposited in said coin chute to permit operation of said patron lock; and means for returning said operator means to said first position thereof incident to movement of said locking device between said unlocking and locking positions thereof.

2. The improvement according to claim 1, wherein said first position of said operator means is disposed vertically above said sensing station, said pawl means is supported for pivotal movements about an essentially horizontally disposed axis arranged to extend transversely of said coin chute adjacent one vertically disposed edge thereof, said pawl means includes upper and lower coin engaging pins disposed essentially parallel to said axis and associated upper and lower ratchet teeth engaging pawl elements, said coin detecting means additionally includes stationary reference means disposed vertically intermediate said upper and lower engaging pins and adjacent an opposite vertically disposed edge of said coin chute, said coins passing downwardly through said coin chute being constrained first to pass between said upper engaging pin and said reference means and then between said lower engaging pin and said reference means, said pawl means having a first pivotal position wherein said upper and lower pawl elements engage and are removed from engagement with said ratchet teeth and their associated upper and lower pins are disposed in coin engaging and operative positions, respectively, and a second pivotal position wherein said upper and lower pawl elements are removed from engagement and engaged with said ratchet teeth and their associated upper and lower coin engaging pins are disposed in operative and coin engaging positions, respectively, said upper and lower pins when in said coin engaging position thereof being spaced from said reference means through a distance less than said given diameter, but greater than the diameter of a next smaller diameter coin of said given currency, and when in said operative position thereof being spaced from said reference means through a distance sufficient to permit passage of said coins of given diameter therebetween, characterized in that passage of a coin of said given denomination downwardly within said coin chute first between said upper engaging pin and said reference means and then between said lower engaging pin and said reference means successively effects movement of said pawl means from said first position into said second position and then return movement into said first position, whereby to permit stepwise movement of said operator means through said given distance.

3. The improvement according to claim 1 or 2, wherein said operator means is supported on said coin chute for vertical sliding movements and is biased by gravity for movement downwardly from said first position thereof, said member is releasably clamped to said operator means selectively in one of said plurality of positions determined by a pin means carried by one of said member and operator means and by a plurality of recess means carried by the other of said member and operator means, said recess means being sized to removably receive said pin means.

4. The improvement according to claim 2, wherein said coin detecting means additionally includes a mounting plate fixed to said coin chute for mounting said operator means for vertical sliding movements and for mounting said pawl means for pivotal movements, said one vertically disposed edge of said coin chute is defined by upper and lower vertically extending coin edge guides having their relatively adjacent ends spaced vertically of said coin chute to accommodate said upper and lower coin engaging pins therebetween, said upper coin engaging pin being horizontally outwardly of said upper guide in both said coin engaging and operative positions thereof, and said mounting plate includes a blocking flange portion disposed horizontally outwardly of and vertically intermediate said coin engaging pins for preventing passage of coins from said coin chute horizontally outwardly between said coin engaging pins.

5. The improvement according to claim 4, wherein said member is releasably clamped to said operator means selectively in one of said plurality of positions determined by pin means carried on one of said member and operator means and by a plurality of recess means carried by the other of said member and operator means, said recess means being sized to removably receive said pin means.

6. In a coin operated lock unit of the type having a coin chute through which coins having a diameter not exceeding a given diameter of a coin of a given denomination of a given currency are permitted to pass on edge therethrough, a patron lock coupled with a locking device movable upon operation of said patron lock between unlocking and locking positions, and restraining means normally operable for preventing movement of said locking device from said unlocking position into said locking position until a predetermined number of coins of said given denomination have been deposited in said coin chute, the improvement wherein said restraining means comprises in combination:

coin detecting means including operator means supported for movement relative to a sensing station from and for return to a first position, and being biased for movement from said first position towards said sensing station, said operator means having ratchet teeth spaced apart in alignment with the direction of movement thereof, a coin sensing pawl means for permitting stepwise movement of said operator means towards said sensing station in response to the depositing of successive coins of said given denomination within said coin chute, said pawl means being supported for pivotal movements about an axis arranged to extend transversely of said coin chute adjacent one vertically disposed edge thereof, said pawl means having upper and lower coin engaging pins and associated upper and lower ratchet teeth engaging pawl elements, said pawl means having a first pivotal position wherein said upper and lower pawl elements engage and are removed from engagement with said ratchet teeth and their associated upper and lower pins are disposed in coin engaging and operative positions, respectively, and a second pivotal position wherein said upper and lower pawl elements are removed from engagement and engaged with said ratchet teeth and their associated upper and lower pins are disposed in operative and coin engaging positions, respectively, and a stationary reference means disposed vertically intermediate said upper and lower pins and adjacent an opposite vertically disposed edge of said coin chute, said coin passing through said coin chute being constrained first to pass between said upper pin and said reference means and then between said lower pin and said reference means, said upper and lower pins when in said coin engaging position thereof being spaced from said reference means through a distance less than said given diameter and when in said operative position thereof being spaced from said reference means through a distance sufficient to permit passage of said coins of given diameter therebetween, characterized in that passage of each coin of said given denomination downwardly within said coin chute first between said upper pin and said reference means and then between said lower pin and said reference means effects pivotal movement of said pawl means from said first position into said second position and then return pivotal movement into said first position, whereby to permit a stepwise movement of said control means towards said sensing station, and further characterized in that said distance between said upper and lower pins when in said coin engaging position thereof and said reference means permits coins of said given currency having a diameter smaller than said given diameter to pass downwardly between said upper pin and said reference means and then between said lower pin and said reference means without requiring movement of said upper and lower pins from their coin engaging into their operative positions;

sensing means for releasing said locking device for movement into said locking position upon movement of said operator means into said sensing station; and means for returning said control means to said first position thereof incident to movement of said locking device between said positions thereof.

7. The improvement according to claim 6, wherein said control means includes a member adjustably fixed thereto for varying the number of stepwise movements required to move said control means from said first position thereof into said sensing station.

8. The improvement according to claim 6 or 7, wherein said one vertically disposed edge of said coin chute is defined at least in part by a coin edge guide extending vertically from adjacent said upper pin, and said upper pin being disposed horizontally outwardly of said guide in a direction away from said reference means in both said coin engaging and operative positions thereof.

9. The improvement according to claim 6 or 7, wherein said coin detecting means additionally includes a mounting plate fixed to said coin chute for mounting said operator means for vertically sliding movements from and return to said first position thereof and for mounting said pawl means for pivotal movements between said first and second positions thereof, and said plate includes a blocking flange for preventing passage of coins from within said coin chute horizontally outwardly between said pins.

10. An apparatus for use as a replacement for a coin gauging device of a coin operator lock unit of the type having a coin chute downwardly through which coins having a diameter not exceeding a given diameter of a coin of a given denomination of a given currency are permitted to pass on edge, a patron lock coupled with a locking device movable upon operation of said patron lock between unlocking and locking positions, means normally operable for preventing movement of said locking device from said unlocking position into said locking position until feeler means associated therewith senses the presence at a sensing station of a last to be deposited one of a given number of coins of said given diameter supported within said coin chute by said gauging device, said apparatus comprising:

a mounting plate to be fixed to lie adjacent a side surface of said coin chute;

operator means supported by said mounting plate for vertical sliding movements from a first position downwardly past said sensing station whereat it may be engaged by said feeler means to permit movement of said locking device from said unlocking position into said locking position, said operator means having ratchet teeth spaced apart in a direction aligned with the direction of said sliding movements;

coin sensing pawl means for permitting stepwise movements of said operator means from said first position towards said sensing station in response to the depositing of successive coins of said given diameter within said coin chute, said pawl means being supported for pivotal movements by said mounting plate about an axis to be disposed to extend normal to said side surface and adjacent a rear coin edge guide surface of said coin chute, said pawl means having upper and lower coin engaging pins and associated upper and lower ratchet teeth engaging pawl elements, said pawl means having a first pivotal position wherein said upper and lower pawl elements engage and are removed from engagement with said ratchet teeth and their upper and lower pins are arranged relative to said edge guide to assume coin engaging and operative positions, respectively, and a second pivotal position wherein said upper and lower pawl elements are removed from engagement and engaged with said ratchet teeth and their associated upper and lower pins are arranged relative to said edge guide to assume operative and coin engaging positions, respectively;

a stationary reference means fixed relative to said mounting plate and arranged to project into said coin chute in a forwardly spaced relationship to said edge guide and vertically intermediate said upper and lower pins, thereby to cause coins passing downwardly through said coin chute to pass first between said upper pin and said reference means and then between said lower pin and said reference means, said upper and lower pins when in said coin engaging position thereof being spaced from said reference means through a distance less than said given diameter and when in said operative position thereof being spaced from said reference means through a distance sufficient to permit passage of coins of said given diameter therebetween, wherein passage of each coin of given diameter first between said upper pin and said reference means and then between said lower pin and said reference means effects pivotal movement of said pawl means from said first position into said second position and then return pivotal movement into said first position to permit completion of a stepwise movement of said control means towards said sensing station, characterized in that said distance between said upper and lower pins when in said coin engaging position thereof and said reference means permits coins of said given currency having a diameter smaller than said given diameter to pass downwardly between said upper pin and said reference means and then between said lower pin and said reference means without requiring movement of said upper and lower pins from their coin engaging into their operative positions, said control means having sufficient ratchet teeth to permit a minimum number of stepwise movements thereof between said first position and said sensing station at least equal to said given number of coins adapted to be supported by said gauging device it is to replace; and means responsive to movement of said locking device between said position thereof to effect return of said operator means to said first position thereof.

11. An apparatus according to claim 10, wherein said operator means includes a member adjustably fixed thereto for varying the number of stepwise movements required to move said operator means from said first position thereof into said sensing station.

12. In a coin operated lock unit of the type having a coin chute through which coins having a diameter not exceeding a given diameter of a coin of a given denomination of a given currency are permitted to pass on edge therethrough, a patron lock coupled with a locking device movable upon operation of said patron lock between unlocking and locking positions, and restraining means normally operable for preventing movement of said locking device from said unlocking position into said locking position until a predetermined number of coins of said given denomination have been deposited in said coin chute, the improvement wherein said restraining means comprises in combination:

a sensing station having sensing means;

operator means carrying a member and supported for movement relatively towards and away from said sensing station, said operator means and said member being under a bias for effecting movement thereof towards said sensing station, said operator means having ratchet teeth spaced apart in alignment with the direction of movement thereof, said sensing means being engageable with said member upon movement thereof into said sensing station for releasing said locking device for movement into said locking position;

a coin sensing pawl means for permitting stepwise movements of said operator means and said member towards said sensing station under said bias in response to the depositing of successive coins of said given denomination within said coin chute, said pawl means being supported for pivotal movements about an axis arranged to extend transversely of said coin chute adjacent one vertically disposed edge thereof, said pawl means having upper and lower coin engaging pins and associated upper and lower ratchet teeth engaging pawl elements, said pawl means having a first pivotal position wherein said upper and lower pawl elements engage and are removed from engagement with said ratchet teeth and their associated upper and lower pins are disposed in coin engaging and operative positions, respectively, and a second pivotal position wherein said upper and lower pawl elements are removed from engagement and engaged with said ratchet teeth and their associated upper and lower pins are disposed in operative and coin engaging positions, respectively, and a stationary reference means disposed vertically intermediate said upper and lower pins and adjacent an opposite vertically disposed edge of said coin chute, said coins passing through said coin chute being constrained first to pass between said upper pin and said reference means and then between said lower pin and said reference means, said upper and lower pins when in said coin engaging position thereof being spaced from said reference means through a distance less than said given diameter, but greater than the diameter of a next smaller diameter coin of said given currency, and when in said operative position thereof being spaced from said reference means through a distance sufficient to permit passage of said coins of given diameter therebetween, characterized in that passage of each coin of said given denomination downwardly within said coin chute first between said upper pin and said reference means and then between said lower pin and said reference means effects pivotal movement of said pawl means from said first position into said second position and then return pivotal movement into said first position, whereby to permit a stepwise movement of said operator means and said member towards said sensing station;

means for moving said operator means and said member away from said sensing station after engagement of said sensing means with said member for releasing said locking device; and means to adjustably vary the number of said coins of said given denomination required to be deposited in said coin chute to permit movement of said member into said sensing station.

13. The improvement according to claim 12, wherein said operator means, said reference means and said pawl means are carried by a mounting plate fixed to said coin chute.

14. The improvement according to claim 12, wherein said one vertically disposed edge of said coin chute is defined at least in part by a coin edge guide extending vertically upwardly from adjacent said upper pin, and said upper pin is disposed horizontally outwardly of said coin edge guide in a direction away from said reference means in both said coin engaging and operative positions thereof.

15. The improvement according to claim 14, wherein said operator means, said reference means and said pawl means are carried by a mounting plate fixed to said coin chute, and said mounting plate additionally carries means for preventing passage of coins from within said coin chute horizontally outwardly between said pins in a direction away from said reference means.

16. The improvement according to claim 15, wherein said means for adjustably varying the number of said coins of said given denomination required to be deposited includes means to releasably clamp said member selectively in one of a plurality of positions uniformly spaced apart lengthwise of said operator means in alignment with said direction of movement, and the spacing between said positions of said member corresponds essentially to a given distance moved by said operator means incident to each stepwise movement thereof.

* * * * *

UNITED STATES PATENT AND TRADEMARK OFFICE

CERTIFICATE OF CORRECTION

PATENT NO. : 4,423,805
DATED : January 3, 1984
INVENTOR(S) : Douglas A. Barth and Richard J. Chester It is certified that error appears in the above-identified patent and that said Letters Patent are hereby corrected as shown below:

Col. 1, Line 57 - Please change "demonination" to --- denomination ---.

Col. 2, Line 26 - After "pivotal", please insert the word --- movement ---.

Col. 2, Line 29 - Please change "cycle" to --- chute ---.

Col. 6, Line 43 - Please change "thrugh" to --- through ---.

Col. 6, Line 58 - Before the word "movement", please insert --- requiring ---.

Col. 6, Line 63 - Please change "con" to --- coin ---.

Col. 7, Line 31 - Please change the first occurrence of "90b" to --- 90a ---.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*